US007188669B2

(12) United States Patent
Bullock et al.

(10) Patent No.: US 7,188,669 B2
(45) Date of Patent: Mar. 13, 2007

(54) MOTOR COOLER FOR SUBMERSIBLE PUMP

(75) Inventors: Aaron Duane Bullock, Odessa, TX (US); Dick L. Knox, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 350 days.

(21) Appl. No.: 10/965,019

(22) Filed: Oct. 14, 2004

(65) Prior Publication Data

US 2006/0081377 A1 Apr. 20, 2006

(51) Int. Cl.
*E21B 43/00* (2006.01)

(52) U.S. Cl. ..... 166/105; 166/66.4; 166/68; 166/302

(58) Field of Classification Search ..... 166/66.4, 166/68, 105, 107, 302, 369
See application file for complete search history.

(56) References Cited

U.S. PATENT DOCUMENTS

| | | | | |
|---|---|---|---|---|
| 2,280,087 | A | 4/1942 | Hollander et al. | 103/5 |
| 2,735,026 | A | 2/1956 | Moerk | 310/54 |
| 2,993,132 | A | 7/1961 | Luenberger | 310/87 |
| 4,487,257 | A | 12/1984 | Dauphiné | 166/60 |
| 4,580,634 | A | 4/1986 | Cruise | 166/310 |
| 4,582,131 | A | 4/1986 | Plummer et al. | 166/68 |
| 4,616,704 | A | 10/1986 | Johnston | 166/242 |
| 4,749,034 | A | 6/1988 | Vandevier et al. | 166/105 |
| 4,913,239 | A | 4/1990 | Bayh, III | 166/385 |
| 4,981,175 | A | 1/1991 | Powers | 166/265 |
| 5,173,022 | A * | 12/1992 | Sango | 415/169.1 |
| 5,367,214 | A | 11/1994 | Turner, Jr. | 310/87 |
| 5,554,897 | A | 9/1996 | Martin et al. | 310/54 |
| 5,659,214 | A | 8/1997 | Guardiani et al. | 310/87 |
| 5,845,709 | A | 12/1998 | Mack et al. | 166/302 |
| 5,979,559 | A * | 11/1999 | Kennedy | 166/369 |
| 6,202,744 | B1 * | 3/2001 | Shaw | 166/106 |
| 6,364,013 | B1 * | 4/2002 | Watson et al. | 166/105 |
| 6,666,269 | B1 * | 12/2003 | Bangash et al. | 166/310 |

* cited by examiner

*Primary Examiner*—Kenneth Thompson
(74) *Attorney, Agent, or Firm*—Fellers, Snider, Blankenship, Bailey & Tippens

(57) ABSTRACT

A motor cooler for an electrical submersible pump (ESP). The ESP is typically deployed within casing and defines an annular space between the ESP and the casing. The ESP includes a pump having an intake, a motor cooler pump having an output port, a seal section below the motor cooler pump, and a motor located below a well inlet. Fluid is directed downwardly from the motor cooler pump output port to cool the motor. In one example, a shroud directs fluid received from the motor cooler pump output port downwardly past the motor and back up an outside of the shroud. In another example, longitudinal ribs direct flow in an annular space between the ESP and the casing. Fluid from the motor cooler pump output port is directed downwardly between adjacent ribs over a surface of the motor and then back up between another pair of ribs.

18 Claims, 4 Drawing Sheets

MOTOR COOLER FOR SUBMERSIBLE PUMP

FIELD OF THE INVENTION

The present invention relates to submersible pumps, in more particular the invention relates to an electrical submersible pump employing a flow diverter to direct fluid past the pump motor for cooling.

BACKGROUND OF THE INVENTION

Fluid in many producing wells is elevated to the surface by the action of a pumping unit or pumping apparatus installed in the lower portion of the well bore. In recent times there has been increased activity in the drilling of well bores to great depths. The use of water flooding as a means of secondary recovery of oil or other hydrocarbon fluids, after the production thereof has been somewhat depleted, is commonly practiced. Because water flooding produces a considerable quantity of fluid in the producing well bore it is preferable to provide a downhole pumping system capable of producing large quantities of fluid. Electrical submersible pump (ESP) systems have been found to meet this need. The electric motor that is typically used in such systems generates considerable heat. The motor is typically cooled by the transfer of heat to the surrounding annular fluids. In many cases, the pumping unit is set above perforations in the well casing so that the unit can make use of flowing well fluid to produce some convection cooling about the motor. Insufficient fluid velocity will cause the motor to overheat and may lead to early motor failure.

Fluid produced by the pumping unit consists of formation water, oil and quantities of gas. The presence of gas can be significant because gas inhibits the pump from producing liquid, which may result in gas blocking, or locking. Equipment failure may result if a unit is not shut down quickly after gas blocking. It is therefore desirable to place the pump below the well casing perforations to take advantage of the natural annular separation of the gas from the liquid. However, by placing the pump below casing perforations, the motor of the pumping unit is not exposed to flowing well fluid that normally provides cooling to the motor of the electrical submersible pump. As a result, a motor in a pumping unit placed below casing perforations tends to overheat and may experience a shortened operational life unless a means for circulating fluid over the surface of the motor is provided.

In some applications, fluid flow past the motor is achieved by drawing fluid through the annulus between the motor and the casing. Disadvantages associated with this arrangement include scale deposited by the fluid in proximity to the hot motor. The scaling problem is exacerbated by the pressure drop associated with drawing the fluid through the annular space surrounding the motor. Scale deposits can block fluid flow and may result in increased difficulties when attempting to remove the electrical submersible pump.

SUMMARY OF THE INVENTION

It is therefore an object of the invention to provide an electrical submersible pump (ESP) that circulates fluid past the motor of the pumping unit. By circulating fluid past the motor, the fluid provides forced convection cooling. Additionally, the motor cooler of the invention forces fluid through the annulus between the motor and the well casing, which results in decreased scaling as compared to pulling or drawing the fluid through the annulus.

A motor cooler is provided for an electrical submersible pump (ESP). The electrical submersible pump is typically deployed within well casing. An annular space is defined between the electrical submersible pump and the well casing. The electrical submersible pump includes a pump having an intake located below casing perforations, a motor cooler pump having an output port, a seal section below the motor cooler pump, and a motor located below the seal section. A flow director directs fluid downwardly from the output port of the motor cooler pump past the motor.

An example flow director is a shroud that sealingly engages the electrical submersible pump at an upper end of the shroud and directs fluid received from the motor cooler pump output port downwardly past the motor, i.e., the shroud configuration may be termed a "positive reverse flow shroud setup". Fluid then flows upwardly outside of the shroud. Utilizing the motor cooler of the invention reduces the potential for scale deposits because the pressure drop normally associated with a typical shrouded ESP is eliminated. Advantages include maximization of production from oil, water, and gas wells, reduced potential for scale formation, and reduced gas entry into the pumping system.

Another example flow director is a downflow channel partially formed by longitudinal ribs in an annular space between the electrical submersible pump and the casing. This embodiment of the motor cooler of the invention is suited for use in small diameter casing, which may be too small to receive a shroud. Longitudinal ribs are located on the motor to form channels for well fluid to flow between the motor and the well casing. Some of the channels, e.g., half of the channels, receive fluid from output ports of the motor cooler pump and allow fluid to flow downward Thee channels may be referred to as "downflow channels". The remaining channels, i.e., "upflow channels" allow fluid to flow back up and into the production pump. Centralizers may be used to center the motor in the casing. Preferably, ribs and centralizers are the same component. The ribs may be flexible or retractable, e.g., spring loaded rigid members, to allow the ribs to conform to the casing and not restrict installation of the electrical submersible pump system. However, forming a seal with the casing is not critical as pressures within the downflow channels and upflow channels are relatively low, and the flow rate within the channels will likely be high enough to compensate for any bypassed fluid.

DETAILED DESCRIPTION OF THE PREFERRED EMBODIMENT

Figures 1, 1A:
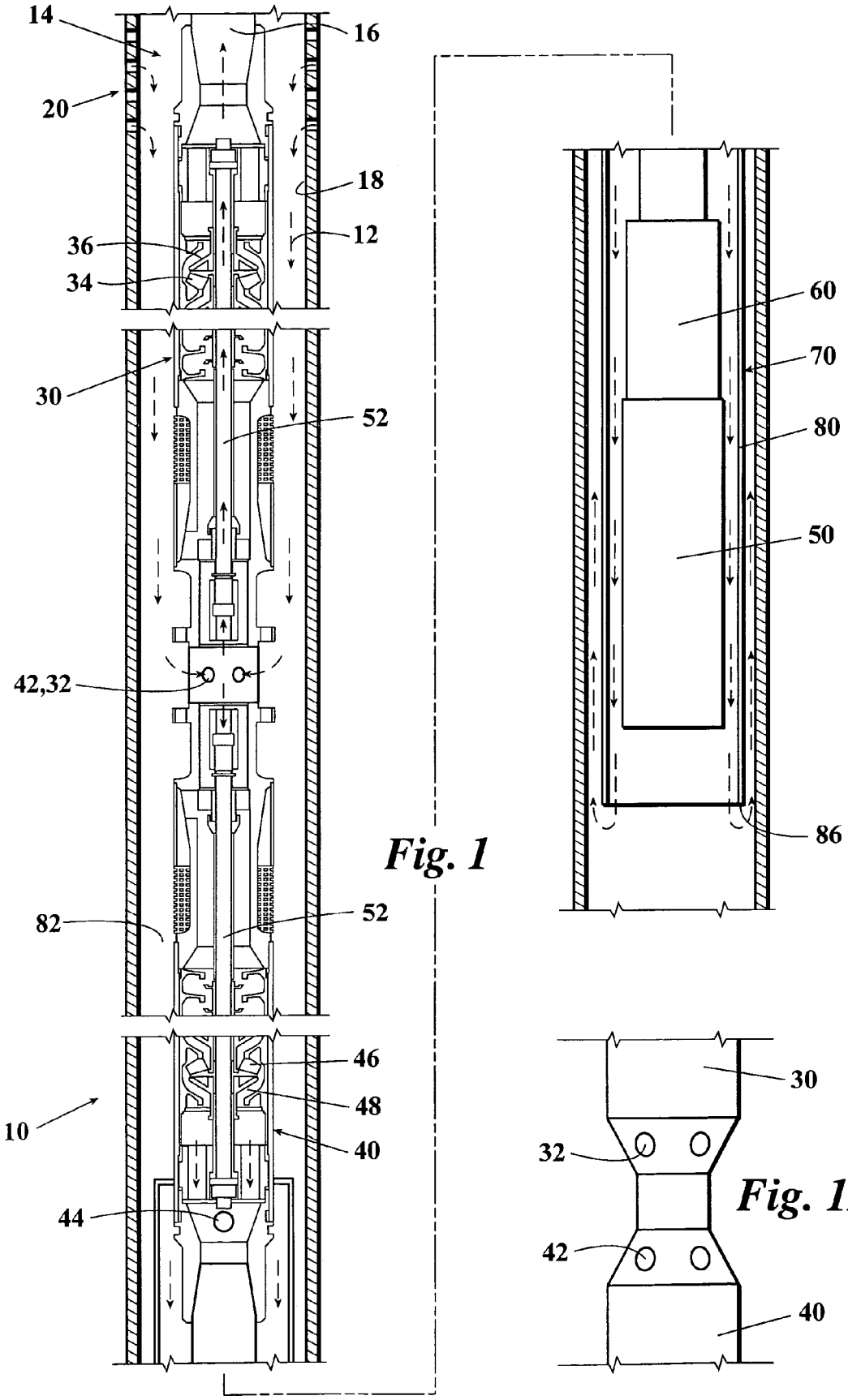
FIG. 1 is schematic view of an electrical submersible pump system utilizing the motor cooler of the invention wherein the flow director is a positive seal shroud.
FIG. 1A is a schematic view of an alternate configuration of the electrical submersible pump system of FIG. 1 having separate intakes for the production pump and the motor cooler pump.
Figure 2:
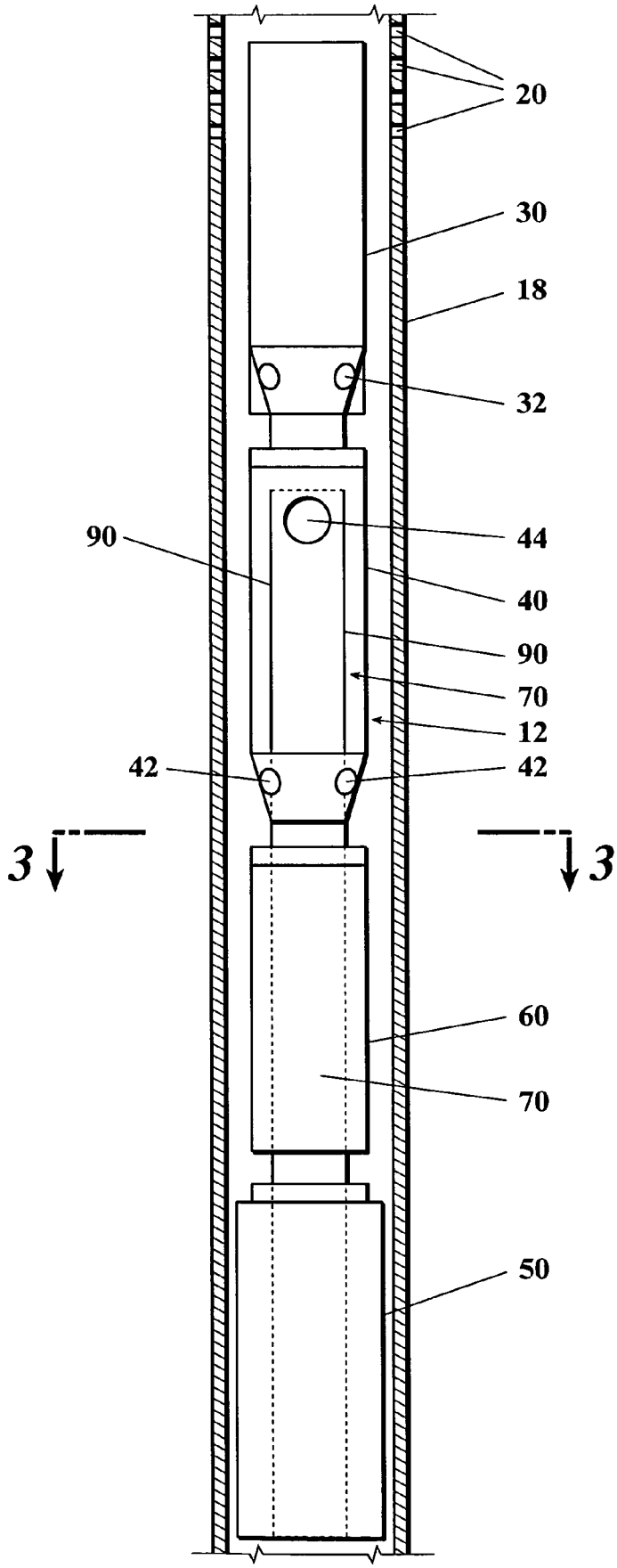
FIG. 2 is a schematic view of an electrical submersible pump system utilizing the motor cooler of the invention wherein the flow director is a plurality of longitudinal ribs.

Referring now to FIGS. 1–4, shown is a motor cooler system 10 for use with an electrical submersible pump (ESP) 12. As shown in FIGS. 1 and 2, an electrical submersible pumping unit 12 is typically suspended on production tubing 16 inside of casing 18 below a well inlet, such as casing perforations 20.

Electrical submersible pumping unit 12 includes a production pump 30 for directing well fluid upwardly through production tubing 16. Production pump 30 has an intake 32 for receiving well fluids. Production pump 30 may be made up of one or more stages. Each stage includes a plurality of impellers 34 and diffusers 36 (FIG. 1), which are oriented to generate an upward flow of fluid.

Electrical submersible pumping unit 12 additionally includes a motor cooler pump 40 which is preferably set below production pump 30. Motor cooler pump 40 is provided for directing motor cooling fluid flow downwardly. Motor cooler pump 40 has a motor cooler intake port 42 for receiving well fluids. In one embodiment (FIG. 1), intake port 42 for motor cooler pump 40 is also intake port 32 for production pump 30. In another embodiment (FIG. 1A), intake port 42 of motor cooler pump 40 is separate from intake 32 of production pump 30. Motor cooler pump 40 is additionally provided with an output port 44 for discharging motor cooling fluid. Motor cooler pump 40 is provided with one or more stages each having a plurality of impellers 46 and diffusers 48 (FIG. 1). In one embodiment (FIG. 1), impellers 46 and diffusers 48 are inverted with respect to impellers 34 and diffusers 36 of production pump 30. Additionally, in the embodiment of FIG. 1, the impellers 46 and diffusers 48 are of a reverse configuration as compared to impellers 34 and diffusers 36. Therefore, impellers 46 may be driven by the same shaft and in the same direction as impellers 34 of production pump 30 but produce downward flow of fluid for motor cooling purposes rather than upward flowing fluid for production purposes.

Alternatively, in the embodiment of FIG. 2, production pump 30 and cooling pump 40 may be oriented in the same direction and utilize similarly configured impellers 34, 46, and diffusers 36, 48 (not shown in FIG. 2). In the embodiment of FIG. 2, as will be discussed below, flow channels are provided to direct cooling fluid flow. Although motor cooler pump 40 is shown below production pump 30 in the embodiments of FIGS. 1 and 2, it should be understood that motor cooler pump 40 may also be located above production pump 30.

Motor 50 is located below and operably connected to production pump 30 and motor cooler pump 40 for driving the impellers 34 of production pump 30 and impellers 46 of motor cooler pump 40. Motor 50 (FIG. 1) rotates shaft 52, which may comprise various segments. Shaft 52 extends through seal section 60, motor cooler pump 40, and production pump 30 for driving components in each section. A seal section 60 is typically provided between motor 50 and motor cooler pump 40.

A flow director 70 is provided adjacent seal section 60 and motor 50 for directing the motor cooling fluid past motor 50. In one embodiment (FIG. 1), flow director 70 is a shroud 80. Shroud 80 is provided with an enclosed, upper portion 82. Enclosed upper portion 82 seals against an outer wall submersible pumping unit 12, such as an outer well of motor cooler pump 40, at a location above output port 44. Shroud 80 surrounds seal section 60 and motor 50. A lower end 86 of shroud 80 preferably extends at least to the bottom edge of motor 50 so that motor cooling fluid flows along the entire length of motor 50. However, shroud 80 may cover only a portion of or terminate at a location proximate motor 50 if necessary.

Figure 3:
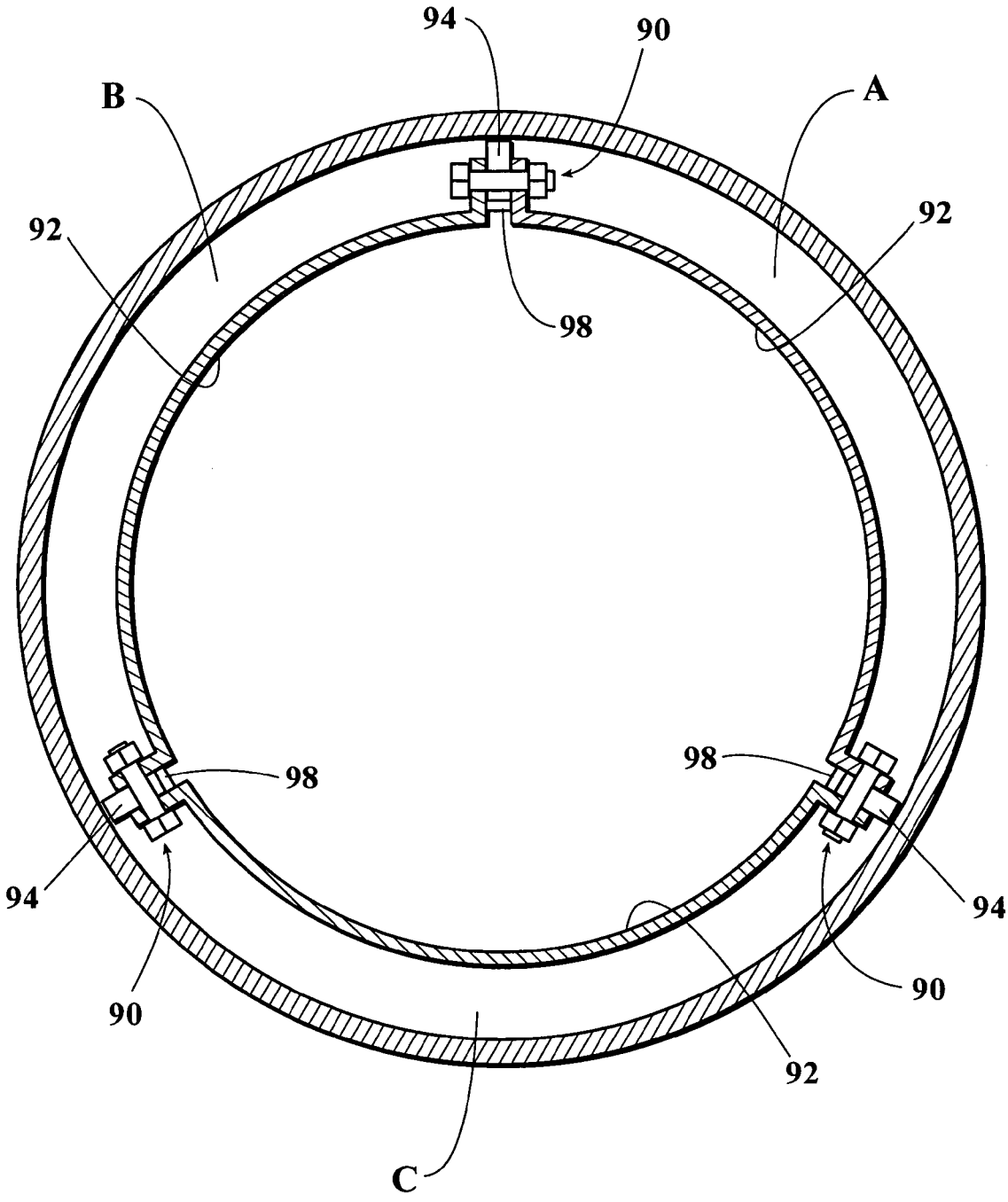
FIG. 3 is a cross-sectional view taken along lines 3—3 of FIG. 2.
Figure 4A:
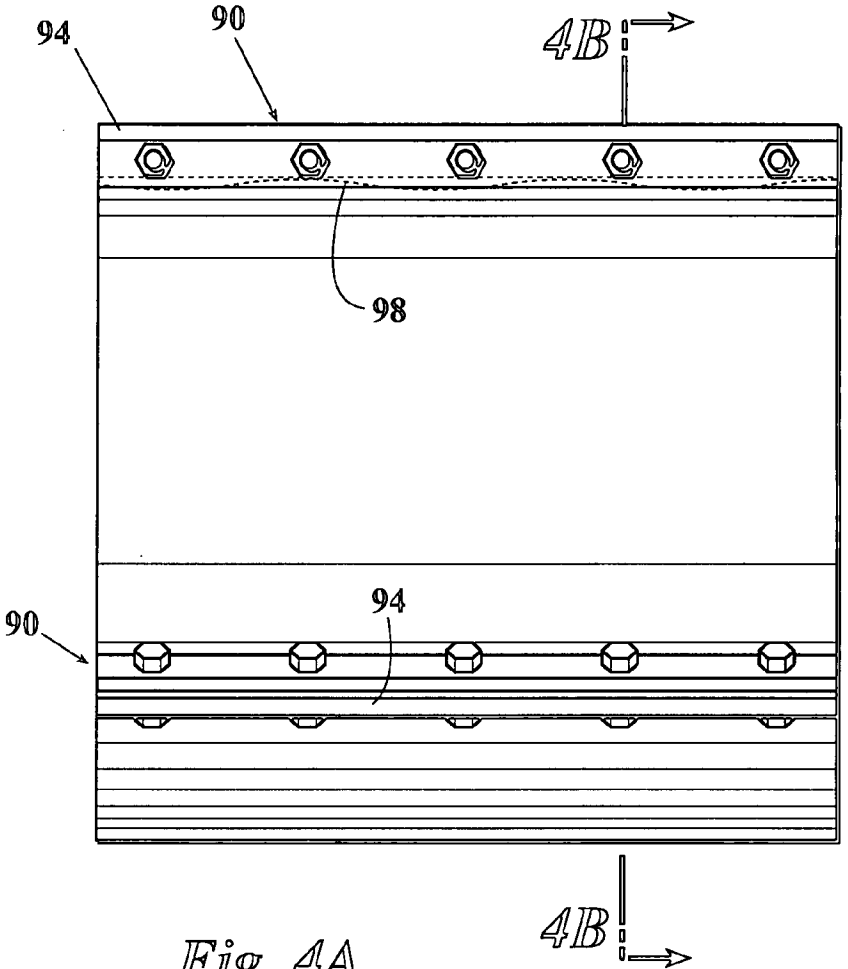
FIG. 4 is a perspective view of clamping plates used to form the longitudinal ribs of FIGS. 2 and 3.
Figure 4B:
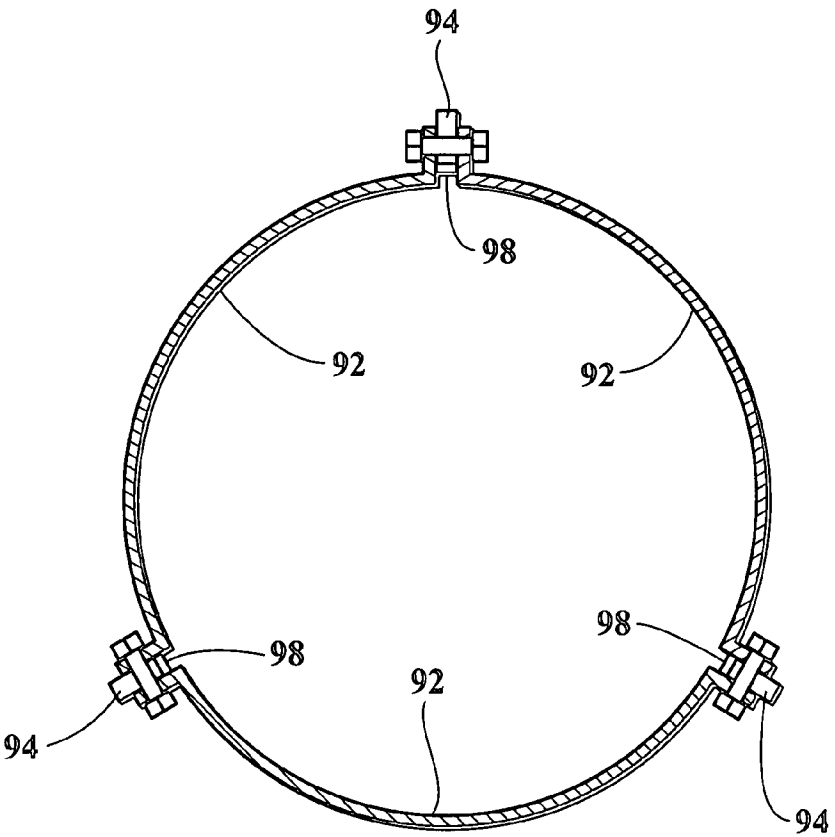

In another embodiment (FIG. 2), flow director 70 is comprised of a plurality of ribs 90 for separating annulus 91 (FIG. 3) defined by electrical submersible pumping unit 12 and casing 18 into distinct channels, e.g., channel A, channel B and channel C (FIG. 3). In other words, ribs 90 isolate discharge from output port 44 (FIG. 2) for directing flow towards the bottom of motor 50 within a channel. Ribs 90 are preferably formed at a junction of adjacent clamping segments 92. As shown in FIGS. 3–4B, ribs 90 preferably include a flexible material 94, such as rubber, to allow for movement of electrical submersible pumping unit 12 during installation and to allow some sealing action against casing 18. Preferably, a spring member 98 is located adjacent ribs 90 to bias flexible member 94 outwardly against casing 18. Spring member 98 assists in facilitating a seal between flexible member 94 and casing 18. However, a complete sealing engagement of ribs 90 to casing 18 is not required, as established flow of cooling fluid within a channel is typically substantially higher than any leakage amount, thereby allowing sufficient flow through the desired channel to provide adequate cooling of motor 50. Ribs 90 may be aligned so that the power cable for the motor is positioned in one of flow channels A, B, or C. Such cable placement would not require additional sealing as is typically required when the power cable must pass through a member, such as a shroud. Although three channels, i.e., channels A, B, and C, are shown for purposes of example, it should be understood that any number of channels could be used. At least three channels are preferred, however, because the use of at least three ribs 90 functions to assist in centering the electrical submersible pumping unit 12 within casing 18.

In use, a motor cooling system 10 utilizing a flow director 70 allows for placement of electrical submersible pumping unit 12 below casing perforations 20 while facilitating fluid flow past motor 50 for maintaining operating temperatures of motor 50 in an acceptable range. In one embodiment, to facilitate fluid flow past motor 50, a motor cooler pump 40 directs well fluid out output ports 44 and into an annular space defined by an inner surface of shroud 80 and outer surfaces of seal sections 60, motor 50, and an inner surface of wall 84. In the shrouded embodiment, the motor cooling fluid is forced outwardly and upwardly between an outer surface of shroud 80 and an inner surface of casing 18. Advantages associated with the cooling system of the invention include directing cooling fluid past motor 50 under positive pressure, which provides advantages associated with reduced scale deposits as compared to drawing cooling fluid past the motor with a low pressure intake.

In another embodiment, to facilitate fluid flow past motor 50, a motor cooler pump 40 directs well fluid out output ports 44 and into a channel in annular space 91 defined by an outer surface of clamping segment 92, an inner surface of casing 18, and adjacent ribs 90. As shown in FIG. 2, one of the channels, e.g., channel A (FIG. 3), communicates with output port 44. Therefore, referring to FIG. 3, channel A functions as a pathway for downwardly directed fluid flow while channel B and Channel C function as a return pathway for upwardly directed fluid. Depending upon the particular arrangement of output ports 44 and intake ports 42, the number of channels for downwardly directed fluid and upwardly directed fluid can be adjusted as required, i.e., the total number of channels may be varied as desired. In the three channeled embodiment of FIGS. 2–4B, channels A, B, and C, may be set up as "two down, one up" or "one down, two up" as required. In this example, cooling fluid is forced through annular space 91 inside of channel A and past motor 50 to a location preferably below the lower end of motor 50. The continued delivery of cooling fluid down channel A results in the fluid being forced back up other channels, e.g., channel B and channel C.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A well comprising:

well casing defining a well inlet therein;

a submersible pump assembly deployed within said well casing and defining an annular space therebetween, said submersible pump assembly comprising:

a motor for driving a shaft, said motor below said well inlet;

a pump operably connected to said shaft, said pump having an intake;

a motor cooler pump operably connected to said shaft, said motor cooler pump having an output port;

a flow director surrounding said motor for receiving fluid from said output port of said motor cooler pump and directing fluid flow adjacent to said motor.

2. The well according to claim 1 wherein:

said pump has a plurality of stages each comprised of an impeller and a diffuser; and said motor cooler pump has a plurality of stages each comprised of an impeller and a diffuser, wherein said impellers and diffusers of said motor cooler pump are oriented oppositely with respect to said impellers and diffusers of said pump.

3. The well according to claim 1 wherein:

said flow director comprises a shroud having an upper portion sealingly engaging said submersible pump assembly, said shroud for receiving fluid from said output port of said motor cooler pump and providing a downflow space for directing fluid over a surface of said motor.

4. The well according to claim 3 further comprising:

an annular space defined by an outside surface of said shroud and said well casing, said annular space for providing an upflow space for fluid to pass from below said motor upwards past said motor.

5. The well according to claim 1 wherein:

said flow director comprises a downflow channel defined in part by adjacent longitudinal ribs and said well casing, said downflow channel for receiving fluid from said output port of said motor cooler pump and for directing fluid over a surface of said motor.

6. The well according to claim 5 further comprising:

at least one upflow channel defined in part by adjacent longitudinal ribs for receiving fluid from below said motor and for directing fluid upwards past said motor.

7. The well according to claim 5 wherein:

said flow director is comprised of three longitudinal ribs defining two upflow channels and one downflow channel.

8. The well according to claim 5 wherein:

at least one of said longitudinal ribs comprises a flexible member for engaging an inner wall of said well casing.

9. The well according to claim 5 wherein:

said at least one longitudinal rib includes a biasing member for biasing said longitudinal rib against said inner wall of said well casing.

10. A well comprising:

well casing defining a well inlet therein;

a submersible pump assembly deployed within said well casing and defining an annular space therebetween, said submersible pump assembly comprising:

a motor for driving a shaft, said motor below said well inlet;

a pump operably connected to said shaft, said pump having an intake;

a motor cooler pump operably connected to said shaft, said motor cooler pump having an output port;

a shroud proximate said motor for receiving fluid from said output port of said motor cooler pump and for directing fluid over a surface of said motor.

11. The well according to claim 10 wherein:

said shroud is sealingly engaged with said submersible pump assembly at an upper portion of said shroud.

12. The well according to claim 10 wherein:

said shroud defines an annular downflow space between said shroud and said submersible pump assembly; and said shroud defines an annular upflow space between said shroud and said well casing.

13. A well defining:

well casing defining a well inlet therein;

a submersible pump assembly deployed within said well casing and defining an annular space therebetween, said submersible pump assembly comprising:

a motor for driving a shaft, said motor below said well inlet;

a pump operably connected to said shaft, said pump having an intake;

a motor cooler pump operably connected to said shaft, said motor cooler pump having an output port;

a plurality of longitudinal ribs in said annular space defined by said submersible pump assembly and said well casing.

14. The well according to claim 13 wherein:

an adjacent pair of said plurality of longitudinal ribs define a portion of a downflow channel for receiving fluid from said output port of said motor cooler pump and directing fluid over a surface of said motor.

15. The well according to claim 13 wherein:

an adjacent pair of said plurality of longitudinal ribs define a portion of an upflow channel for passing fluid from a location below said motor to a location above said motor.

16. The well according to claim 13 wherein:

said plurality of longitudinal ribs comprises three longitudinal ribs.

17. The well according to claim 13 wherein:

at least one of said plurality of longitudinal ribs comprises a flexible member for engaging an inside surface of said well casing.

18. The well according to claim 13 wherein said rib comprises:

a biasing member for biasing at least one of said plurality of longitudinal ribs against said well casing.

* * * * *